US006828072B1

(12) United States Patent
Yamazaki et al.

(10) Patent No.: US 6,828,072 B1
(45) Date of Patent: Dec. 7, 2004

(54) TONER MIXTURE AND PROCESS FOR PREPARING THE SAME

(75) Inventors: Masahito Yamazaki, Tokyo (JP); Jiro Takemoto, Tokyo (JP); Hiromi Ueno, Tokyo (JP); Koji Akiyama, Tokyo (JP); Jean-Philip Hulin, Poing (DE); Josef Knott, Poing (DE); Manfred Münz, Poing (DE); Andreas Paul, Poing (DE)

(73) Assignee: OCE Printing Systems GmbH, Poing (DE)

( * ) Notice: Subject to any disclaimer, the term of this patent is extended or adjusted under 35 U.S.C. 154(b) by 0 days.

(21) Appl. No.: 10/204,823

(22) PCT Filed: Feb. 24, 2000

(86) PCT No.: PCT/EP00/01561

§ 371 (c)(1),
(2), (4) Date: Dec. 13, 2002

(87) PCT Pub. No.: WO01/63366

PCT Pub. Date: Aug. 30, 2001

(51) Int. Cl.[7] ..... G03G 9/087

(52) U.S. Cl. ..... 430/107.1; 430/109.4; 430/137.21

(58) Field of Search ..... 430/107.1, 109.4, 430/137.21

(56) References Cited

U.S. PATENT DOCUMENTS

| | | | | |
|---|---|---|---|---|
| 4,609,279 A | | 9/1986 | Hausmann et al. | |
| 5,370,962 A | | 12/1994 | Anderson et al. | |
| 5,415,963 A | | 5/1995 | Toya et al. | |
| 5,546,178 A | | 8/1996 | Manzer et al. | |
| 5,659,875 A | | 8/1997 | Manzer et al. | |
| 5,916,722 A | | 6/1999 | Creatura et al. | |
| 6,002,903 A | * | 12/1999 | Hayase et al. | 430/109 |

FOREIGN PATENT DOCUMENTS

| | | |
|---|---|---|
| EP | 0 409 557 A2 | 1/1991 |
| GB | 1 583 998 A | 2/1981 |

OTHER PUBLICATIONS

Patent Abstracts of Japan, Publication No: 03–122662 (to Canon Inc.). May 24, 1991.
Patent Abstracts of Japan, Publication No: 04–239021 (to Mitsubishi Rayon Co., Ltd), Aug. 26, 1992.
Patent Abstracts of Japan, Publication No: 06–011885 (to Canon Inc.), Jan. 21, 1994.

* cited by examiner

*Primary Examiner*—John L Goodrow
(74) *Attorney, Agent, or Firm*—Scully, Scott, Murphy & Presser

(57) ABSTRACT

The present invention describes a process for preparing a toner mixture comprising mixing a first toner with at least one further toner wherein the first toner has an acid value of from 0.1 to 30 mgKOH/g and comprises at least one binder resin and at least one coloring agent wherein said binder comprises as the main component a polyester resin and wherein the further toners comprise at least a binder resin and optionally at least one coloring agent. It also describes a developer composition comprising said toner mixture and optionally a carrier. The new toner mixture does not show any de-mixing phenomenon during repeated use.

16 Claims, 7 Drawing Sheets

TONER MIXTURE AND PROCESS FOR PREPARING THE SAME

Figure 1A:
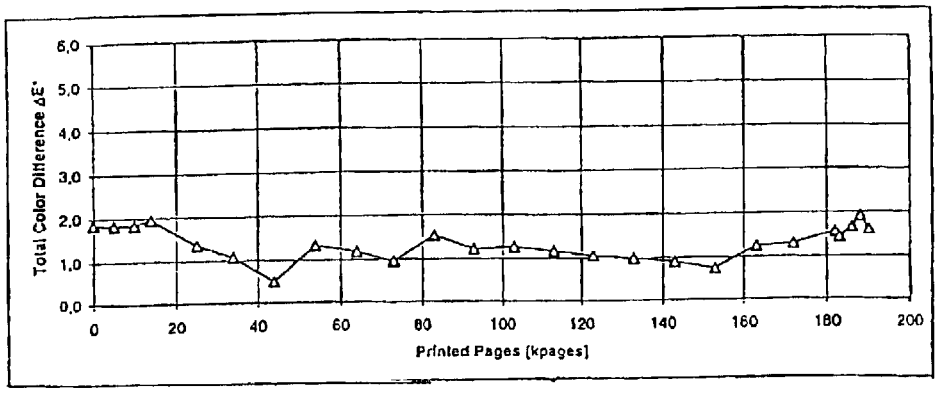

The present invention is directed to a process for the preparation of a toner mixture using at least two toners which comprise at least a binder resin and optionally a coloring agent. Moreover, the present invention is directed to a developer composition comprising a mixture of at least two of said toners and optionally a carrier.

A process for preparing a colored toner blend is known from EP-B-0 614 128. According to the teaching of this document, the toners comprise a resin, pigment particles, an internal charge additive, and optionally surface additives. Moreover, each toner contains a blend compatibility component, selected from the group consisting of quaternary ammonium compounds, complexes of distearyl dimethyl ammonium methyl sulfate, organic sulfonates, trialkyl hydrogen ammonium bisulfates, potassium (3,5-di-t-butylsalicylato) borate, calcium salt of salicylatic-acid, tert-butyl salicylic acid complexes, aluminum salt complexes and zinc salt complexes. The surface additives may comprise metal salts of fatty acids, colloidal silica particles, metal oxides or mixtures thereof. It is particularly preferred that the surface additives comprise a mixture of metal salts of fatty acids and colloidal silica. In accordance with the examples, a specified commercially available silica and zinc stearate are used as the surface additives. Owing to the use of the blend compatibility components it is possible to obtain a rapid admixing time of the constituents. More specifically, the blend admix time can be reduced when compared with toner compositions which do not comprise any blend compatibility components.

U.S. Pat. No. 5,370,982 reveals a process for the preparation of colored toners which comprises providing a first toner comprised of resin, pigment particles, internal charge additive, and optional surface additives, adding thereto a second toner comprised of resin, pigment particles, internal charge additive, and optional surface additives, and wherein said toners contain external blend compatibility components.

However, the known toner compositions comprising said blend compatibility additives have disadvantages because they show a demixing phenomenon when they are used for printing or copying purposes. Moreover, it has been found that the color was not constant during a long period of use.

It is thus an object of the present invention to provide a process for the preparation of a toner mixture with improved characteristics so that no demixing occurs and wherein the triboelectric characteristics and, if the toner mixture is used within a two-component developer, the toner concentration and conductivity of toner and carrier components in the developer mixtures are not impaired during a prolonged use.

The present invention provides a process for the preparation of a toner mixture, preferably a colored toner mixture which comprises mixing a first toner with at least one further toner wherein the first toner has an acid value of 0.1 to 30 mgKOH/g and comprises at least one binder resin and at least one coloring agent wherein said binder resin comprises as the main component a polyester resin, and wherein the further toners comprise at least one binder resin and optionally at least one coloring agent. In contrast to the description of U.S. Pat. No. 5,370,962 it is not necessary to use an external blend compatibility component.

Moreover, the present invention provides a developer composition which comprises a mixture of the above mentioned at least two different toners and optionally a carrier.

According to the process it is possible to mix different toners with each other. One or more of these toners may comprise the coloring agent as an optional component, only. It is also possible to use a fluorescent toner and to mix it e.g. with a transparent toner which does not contain any coloring agent and/or further colored toners. It is particularly preferred that the binder resins of the different toners to be mixed are substantially identical. In such a case, the print qualities are excellent even during a long term of use.

Owing to the use of the specified toners it is surprisingly possible to prepare a toner mixture comprising at least two different toners so that a new color can be prepared without resulting in any de-mixing problem. It has been found that no de-mixing of the individual toners occurs even if the toner mixture is repeatedly used. In this regard, the applicants performed experiments in which toner mixtures were used for printing. With each toner mixture 1,000 to up to 200,000 prints have been performed, and no de-mixing tendency could be recognized.

The developer composition, prepared from a specific toner mixture, has an excellent performance. More specifically, the triboelectric characteristics, the toner concentrations and the conductivity of carrier and developer remain unchanged. More specifically, these values approximately correspond to the respective average values of each of the single toners used for preparing said toner mixture. Moreover, also the print quality and especially the background behavior of the toner mixture corresponds to that of the individual toners. Hence, this developer composition may be used for printing or copying purposes.

By mixing at least two different toners with each other it is possible to obtain a plurality of new colours. Hence, the preparation of a wide range of different colours by mixing the individual toners is possible.

It is possible to mix more than two toners with each other. There is no restriction with respect to the mixing ratio of the two or more toners.

The toners have an acid value within the above range. Preferably, the acid value is within the range of 0,1 to 25 mgKOH/g, most preferably 5 to 25 mgKOH/g. The acid value is measured in accordance with JIS K0070 and ASTM D1980-67. If the acid value falls within the ranges as defined herein, especially a good dispersibility of the coloring agents may be obtained, thereby reducing the tribo effect of the coloring agent. Therefore the triboelectric properties of each of the loners are predominantly due to the resin and optional charge control agents and hence the triboelectric characteristics remain stable in the toner mixture.

The binder resin of the first toner and optionally of the further toners comprise a polyester as the main component. It is particularly preferable to use polyesters having similar triboelectrical behavior. Then, the mixing is excellent, and the hue and chroma of the resulting colour do not change during repeated use. The acid value of the binder is not restricted to the range of the acid value of the toner as mentioned above. It may be much higher, e.g. up to approximately 45 mgKOH/g provided that the toner has an acid value falling within the above-mentioned range.

The average (by volume) particle size of the toner particles to be blended is preferably 3 to 20 $\mu$m, more preferably 5 to 15 $\mu$m, as measured by Coulter Multisizer with 100 $\mu$m aperture.

The pigment of the coloring agent may comprise yellow, magenta, cyan, black, red, green, blue, orange, white, gray fluorescent, metallic or metallic effect particles or mixtures thereof. Particles having a metallic effect are commercially available, e.g. under the tradename Iriodine (Merck GmbH) As stated above, it is possible to use a transparent toner which does not contain any coloring agent and to mix the same with at least one further toner which contains a coloring agent.

The amount of the coloring agent in a colored toner is preferably 1% to 25% by weight, based on the total weight of each of the individual toner compositions. More preferably, the amount of the coloring agent is 1% to 10% by weight, based on the toner composition. If a fluorescent toner is used, its fluorescent additive is normally used in a small amount, preferably 0,1% to 1% by weight, because it is highly effective.

The toner mixture may additionally comprise an internal charge controlling agent. The internal charge controlling agent may be a single compound or may be composed of a mixture of different charge controlling agents. The selection of a charge controlling agent depends on whether a positively chargeable toner or a negatively chargeable toner is used.

Examples of a positively chargeable toner include quaternary ammonium salt compounds such as "TP-415" (Hodogaya Chemical Co., Ltd.), "TP-302" (Hodogaya Chemical Co., Ltd.), "TP-4040" (Hodogaya Chemical Co., Ltd.), "Bontron P-51" (Orient Chemical Co., Ltd.) and "Copy Charge PSY" (Clariant GmbH); polyamine resins such as "AFP-B" (Orient Chemical Co., Ltd.); polymer functionalized with quaternary ammonium salt such as "FCA-201-PS" (Fujikura Kasei Co., Ltd.); and with a preference given to TP-415, TP-302 and Bontron P-51.

Examples of a negatively chargeable toner include potassium borobisbenzylate such as "LR-147" (Japan Carlit Co., Ltd.); metal complexes of alkyl derivatives of salicyclic acid such as "Bontron E-81" (Orient Chemical Co., Ltd.), "Bontron E-84" (Orient Chemical Co., Ltd.) and "TN-105" (Hodogaya Chemical Co., Ltd.); Calixarene compounds such as "Bontron E-89" (Orient Chemical Co., Ltd.) and "Bontron F-21" (Orient Chemical Co:, Ltd.); and polymer functionalized with sulfonic acid such as; "FCA-1001-NS" (Fujikura Kasei Co., Ltd.), quaternary ammonium salt compounds such as "Copy Charge NX VP434" (Clariant GmbH), and with a preference given to LR-147, Bontron E-81, and Bontron E-84.

This charge controlling agent is preferably used in an amount of approximately 0,5% to 5% by weight, based on the total amount of each of the toner compositions. Particular preferably, the amount thereof is approximately 1% to 2% by weight.

Optionally, the toner particles may further comprise a wax component which is commonly used in toner compositions. It is preferred to use low molecular weight waxes such as polyolefins which are commercially available. Out of these commercially available polyolefins, polyethylenes and polypropylenes are preferably used. The wax materials are contained in the toner composition in an amount of from about 1% to 10% by weight, based on the total amount of each toner. It is particularly preferred to use such a wax compound in an amount of 1% to 5% by weight.

As a surface additive of each of the toner particles, silica may be used. The silica is a preferably colloidal silica and is commercially available such as Aerosil R-972. This silica is generally present in an amount of from 0,1% to 5% by weight, preferably 0,1% to 1% by weight.

The developer composition of the present invention may comprise in addition to the toner mixture as described above, a carrier. Any carrier generally employed may be used even though it is preferred to use a carrier having a rugged surface. More preferably a porous carrier is used. It is particularly preferred to use a carrier having a large specific surface area because this leads to advantageous effects with respect to the triboelectricity. A particularly preferred carrier includes an iron powder coated with resins. The iron particles preferably have an irregular shape. The carrier preferably has a resistivity of from 7 to 12 log Ω, more preferably 8 to 10 log Ω, as measured by C-Meter of Epping GmbH.

It is preferred that the difference of the apparent densities of the toner particles contained in said toner mixture is 0,1 $g/cm^3$or less, more preferably 0,05 $g/cm^3$ or less.

The toner mixtures prepared in accordance with the process of the present invention may be used in electrographic (which includes electrophotographic, electrostatic, ionographic (e.g. Delphaxf-machines), magnetographic (Nipson process)) imaging and printing operators. These can also be used for colour xerography.

The invention is especially advantageous for the preparation of custom colors individually designed for company logos like Ocè/red, Siemens/green or Exxon/red. So far, it has been difficult to meet these colors by electrographic processes. Therefore, it is common to use re-processed paper with company logos printed by off-set printers and print the necessary digital information e.g. in black on the re-printed paper by high speed electrographic engines later on.

It has been shown that the invention can be used in a highly advantageous way in electrographic printers having two print stations as described more specifically in U.S. Pat. No. 5,546,178 (Manzer) application Ser. No. 428,170, or U.S. Pat. No. 5,659,875 (Hausmann), application Ser. No. 621,163, hereby incorporated into the specification by reference. Those printers comprise a first printing station for printing a first color and a second printing station for printing a second color (e.g. spot color process) on the same front or reverse page. Associated with both printing stations are respective developer stations with respective colored toner in there. By using standard toner of any color, preferably black, in the first printing station, to print text information and toner mixtures according to the invention in the second printing station for printing e.g. company logos or spot color information on the same page, the costly usage of paper re-printed by off-set engines can be avoided and the whole print job can be done merely by that two engines electrographic printer.

Instead of using a printer with two engines, electrographic printers coupled in tandem as described in U.S. Pat. No. 4,609,279 (Hausmann), application Ser. No. 703,915 can also be used.

The developer compositions preferably have a triboelectric charge of from about 5 to 50 $\mu$C/g, more preferably 10 to 40 $\mu$C/g, especially 15–25 $\mu$C/g. Such a range of the triboelectric charge leads to a good transfer of the toner mixture to a paper support. It is also preferred that the difference of the triboelectric charges of the toners to be mixed is at most 20, more preferably at most 10 $\mu$C/g. The triboelectric charge is measured by using a Q/M-Meter device, manufactured by Epping GmbH, Germany. The concentration of the toner mixture in the developer composition is preferably 1 to 10% by weight, more preferably 3 to 7% by weight.

In the following, the present invention is described in greater detail by way of examples. Parts and percentages are by weight unless otherwise indicated.

EXAMPLE 1

Preparation of a Monocolor Red Toner 740 g of polyoxypropylene(2.2)-2,2-bis (4-hydroxyphebyl) propane, 300 g of polyoxyethylene(2.2)-

2.2-bis(4-hydroxyphenyl)propane, 446 g of dimethyl terephthalate, 80 g of isododecenyl succinic anhydride, 114 g of tri-n-butyl 1,2,4-benzenetricarboxylate, and a conventional catalyst used for esteritication are placed in a two-liter four-neck glass flask equipped with a thermometer, a stainless steel stirring rod, a reflux condenser and a nitrogen inlet tube. The reaction is proceeded by heating the contents in a mantle heater in a nitrogen gas stream at 220° C. and at normal pressure for the first half of the course of reaction, and at 220° C. and at a reduced pressure for the second half of the course of reaction, while stirring the contents.

The obtained polyester resin has an acid value of 12 mgKOH/g and a softening point of 130.7° C. as determined by "koka-type" flow tester. This obtained resin is referred to as "Binder Resin (1)".

This Binder Resin (1) was admixed with the further components as defined in Table 1 below to obtain a toner composition.

TABLE 1

Toner Composition

| | Parts by weight |
|---|---|
| Binder resin (1) | 90 |
| Pigment Red "Fast Red 2 BE" (Sanyo Color Works, Ltd.) Positive Charge Control Agent | 5 |
| "Bontron P-51" (Orient Chemical Co, Ltd) Wax "Viscol 550P" (Sanyochemical Industries, Ltd.) | 2 |
| Silica (external additive) "Aerosil R-972" (Nippon Aerosil Co., Ltd.) | 1 |

The above starting materials are blended well using a Henshel mixer, and the mixture is kneaded and cooled using an extruder equipped with a Barrel cooling system. The obtained mixture is roughly pulverized, and the roughly pulverized mixture is finely pulverized using a jet mill. The obtained finely pulverized powder is classified using an air classifier. The obtained classified powder is mixed well with hydrophobic silica (1.0 parts by weight) using a Henshel mixer, to give a positively chargeable monocolor red toner having an average particle diameter of 11,5 $\mu$m, and <5 $\mu$m of less than 2% and having an acid value of 13.9 mgKOH/g. This toner will be abbreviated with A2.51.

Preparation of a Monocolor Dark Blue Toner

The same procedures as in <Monocolor Red Toner> are carried out except that 5 parts by weight of pigment red "Fast Red 2 BE" (manufactured by Clariant) are replaced with 4 parts by weight of Pigment blue "671 CONC-T" (Dainichiseika Color & Chemicals Mfg. Co., Ltd.) and 1 part by weight of pigment red "Fast Red 2 BE" (Sanyo Color Works, Ltd.) to give a positively chargeable dark blue toner. This toner has an acid value of 20.8 mgKOH/g. This toner will be abbreviated with A2.53.

The above two toners were mixed in a weight ratio of 1:1 to give a toner mixture. The resulting toner mixture was printed on an Ocè-Pagestream 350 printer for 190.000 12 inch pages. The color values L*, C* and h in the CIELAB color system were measured every 10000 pages minimum with a spectral color measurement device. The color of the first page was used as reference. The deviations in lightness $\Delta L^*$, in chroma $\Delta C^*$, in hue AH* and the total color deviation $\Delta E^*_{ab}$ were calculated with respect to the reference. Most important is the evaluation of a possible change of the hue. If a color shift occurs, a change in hue will be observed. The value of $\Delta H^*$ was below 1.5, $\Delta E^*$ was below 2.0, no color shift or de-mixing was observed.

Figure 1B:
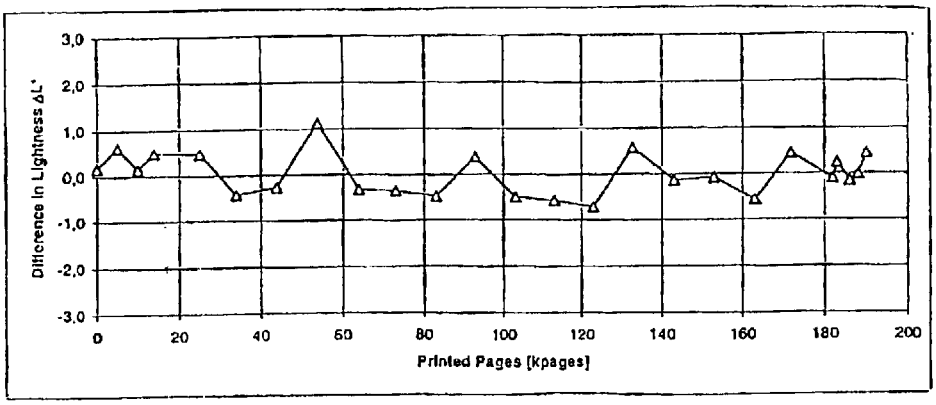
Figure 1C:
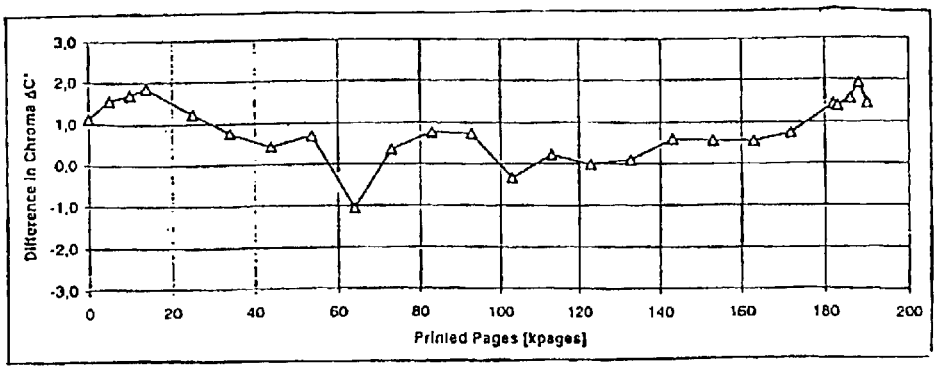
Figure 1D:
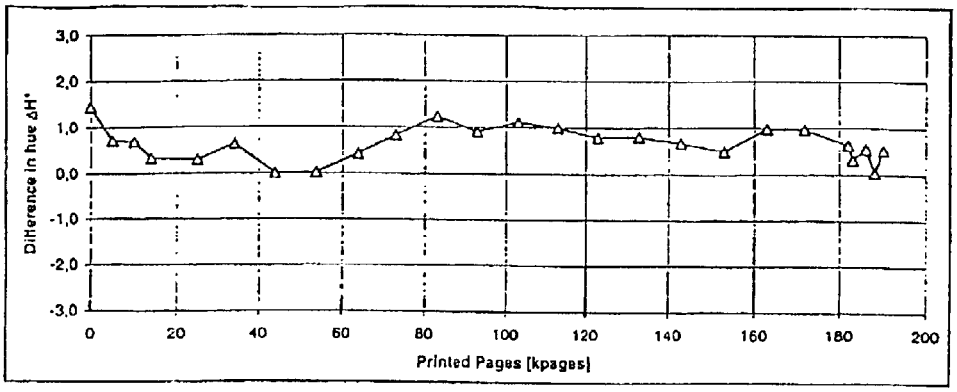

The results of these measurements are shown in FIGS. 1*a*–1*d*.

EXAMPLE 2

Preparation of Another Toner Mixture

Three different toners were mixed: 60% Magenta MCM; 30% Transparent MCT and 10% Yellow MCY. The formulation of the toner MCM was as defined in Table 1 except that the red pigment was replaced with "Toner Magenta E02" (Clariant GmbH) in an amount of 5 parts by weight. The formulation of the toner MCT was as defined in Table 1 except that the amount of the binder resin (1) was 95 parts by weight and that the red pigment was omitted. The formulation of the toner MCY was as defined in Table 1 except that the red pigment was replaced with Paliotol Yellow D1155 (BASF AG) in an amount of 4 parts by weight and the amount of the binder resin (1) was 91 parts by weight. The acid values of the above mentioned toner formulations are as follows:

| Toner | Acid value [mgKOH/g] |
|---|---|
| MCM | 14.3 |
| MCT | 9.4 |
| MCY | 12.0 |

With this toner mixture 40.000 12 inch pages were printed on an Ocè-Pagestream 350 printer. The color of the prints was measured with;a spectral color measurement device. The color difference in the CIELAR color system was calculated. The color of the first printed page was measured and was used as reference for the further experiments. The total color difference remained below $\Delta E^*_{ab}<2.1$.

The resulting toner mixture was printed on an Ocè-Pagestream 350 printer for 40.000 12 inch pages. The color values L*, C* and h in the CIELAB color system were measured every 10000 pages minimum with a spectral color measurement device. The color of the first printed page was used as reference. The deviations in lightness $\Delta L^*$, in chroma $\Delta C^*$, in hue AH* and the total color deviation $\Delta E^*$ were calculated with respect to the reference. Most important is the evaluation of a possible change of the hue. If a color shift occurs, a change of the hue will be observed. The value of $\Delta H^*$ was below 1.4, $\Delta E^*$ was below 2.1, no color shift or de-mixing was observed.

Figure 2A:
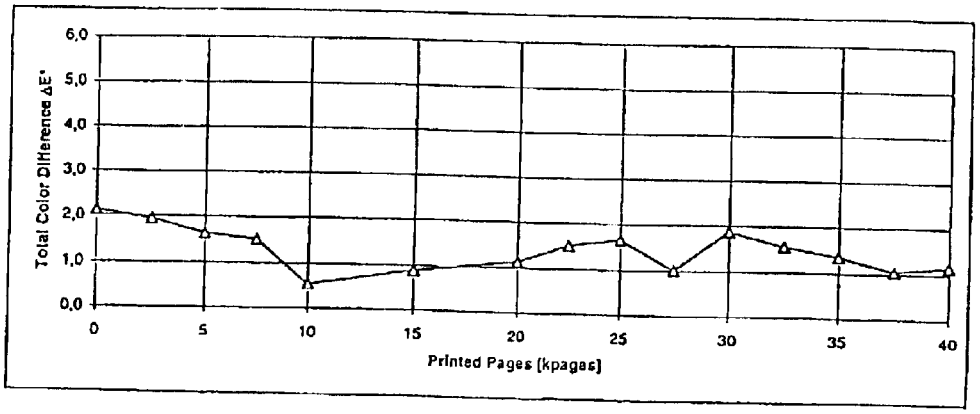
Figure 2B:
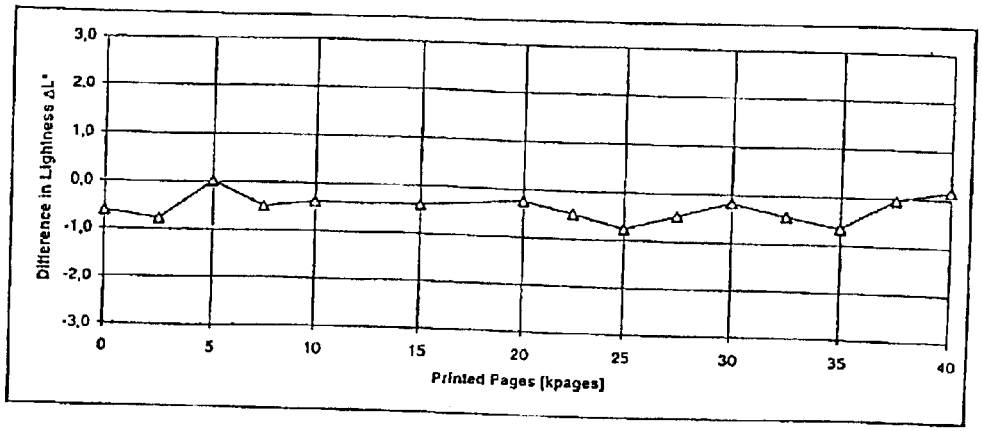
Figure 2C:
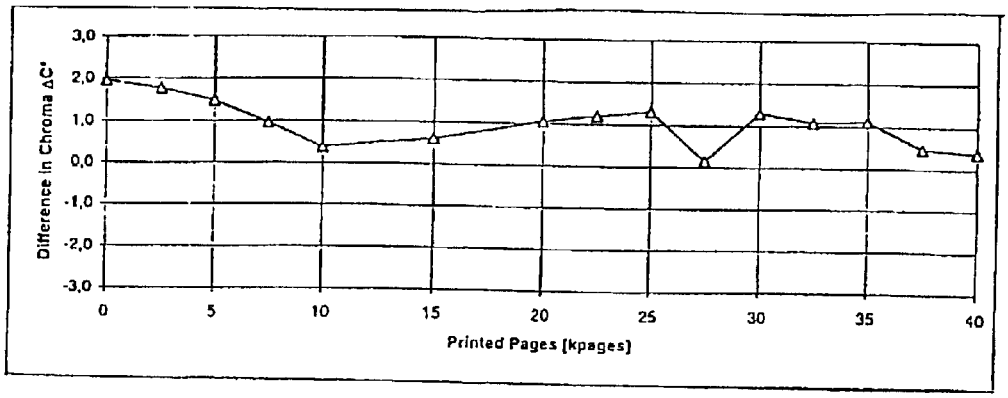
Figure 2D:
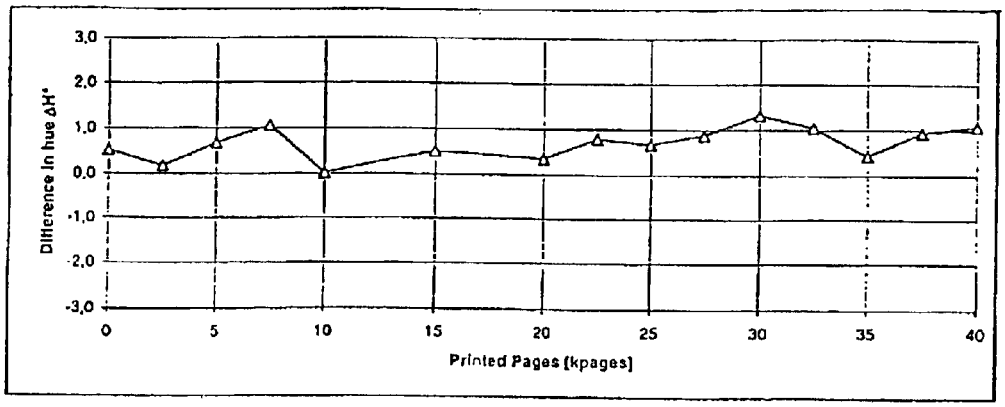

The results of these measurements are shown in FIGS. 2*a*–2*d*.

EXAMPLE 3

A fluorescent toner containing a commercially available fluorescent pigment in an amount of 0.1 parts by weight was used. The formulation of this toner is as defined in Table 1 except that the red pigment was replaced with this fluorescent in the above mentioned amount and that the amount of the binder resin (1) was 94.9 parts by weight. By use of such a toner a toner mixture for creating prints being tamperproof to a high degree can be easily prepared in the following way:

The fluorescent toner is mixed with a second color (e.g. blue) toner which does not contain any fluorescent material in the ratio, 1:4 (weight/weight). This mixture is printed on a substrate which does not contain any optical brighteners. Copies of these prints are prepared by usual copying machines, those copies can be easily identified by the use of a black fluorescent lamp (black light) due to absence of fluorescence. This kind of toner mixture is useful for the printing of tickets or checks.

Fluorescent toners can be used as well to increase the chroma (purity) of colors.

Comparative Example 1

For comparative purposes a toner mixture was prepared by mixing a magenta toner Pat-M-2 which has an acid value of 34.1 mgKOH/g and a cyan toner Pat-C-2 having an acid value of 36.6 mgKOH/g in a weight ratio of 1:1. The magenta toner PAT-M-2 has the hollowing formulation:

| | Parts by weight |
|---|---|
| Binder resin (2) | 90 |
| Toner Magenta E02 (Clariant GmbH) | 5 |
| Positive charged control agent "Bontron P-51" (Orient Chemical Co. Ltd.) | 2 |
| Wax "Viscol 550P" (Sanyo Chemical Industries, Ltd.) | 2 |
| Silica (external additive) "Aerosil R-972" (Nippon Aerosil Co., Ltd.) | 1 |

The binder resin (2) was prepared as described below.

800 g of polyoxypropylene(2.2)-2,2-bis(4-hydroxyphenyl) propane, 200 g of polyoxyethylene(2.2)-2,2-bis(4-hydroxyphenyl)propane, 150 g of terephthalic acid, 420 g of 1,2,4-benzenetricarboxylatic acid, and a conventional catalyst used for esterification are placed in a two-liter four-neck glass flask equipped with a thermometer, a stainless steel stirring rod, a reflux condenser and a nitrogen inlet tube. The reaction is proceeded by heating the contents in a mantle heater in a nitrogen gas stream at 220° C. and at normal pressure for the first half of the course of reaction, and at 220° C. under reduced pressure for the second half of the course of reaction, while stirring the contents.

The obtained polyester resin has an acid value of 33.5 mgKOH/g and a softening point of 134.1° C. as determined by "koka-type" flow tester. This obtained resin is referred to as "Binder Resin (2)".

The toner Pat-C-2 has the same formulation as the toner Pat-M-2 except that 5 parts by weight of the toner Magenta E02 were replaced with 3 parts by weight of "Valifast Blue 2606" (Orient Chemical Co., Ltd.) and that the amount of the binder resin (2) was 92 parts by weight.

Figure 3A:
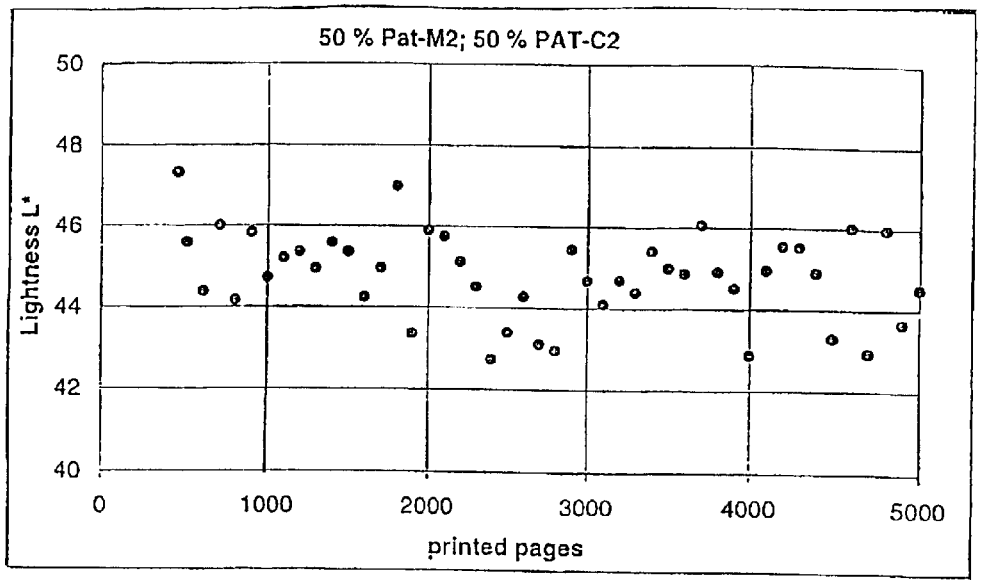
Figure 3B:
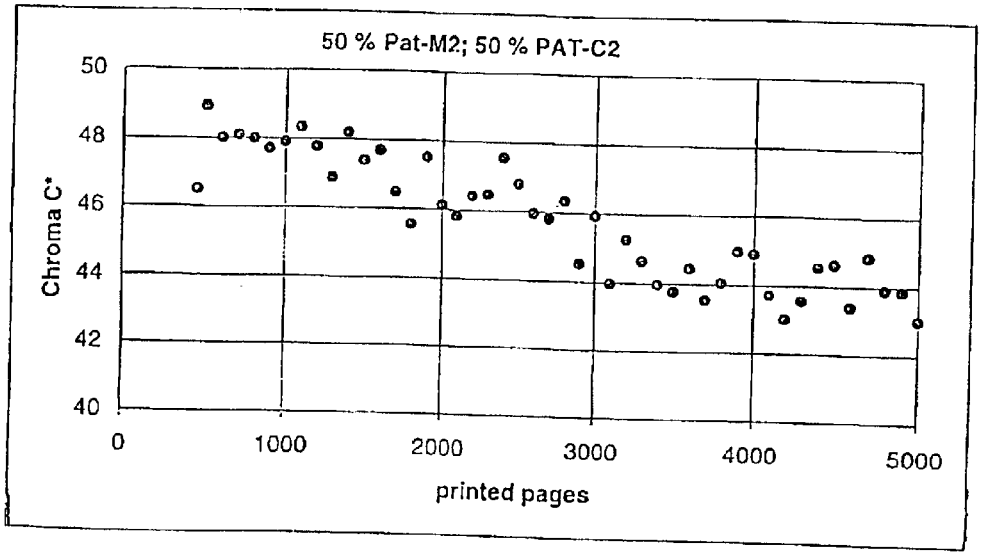
Figure 3C:
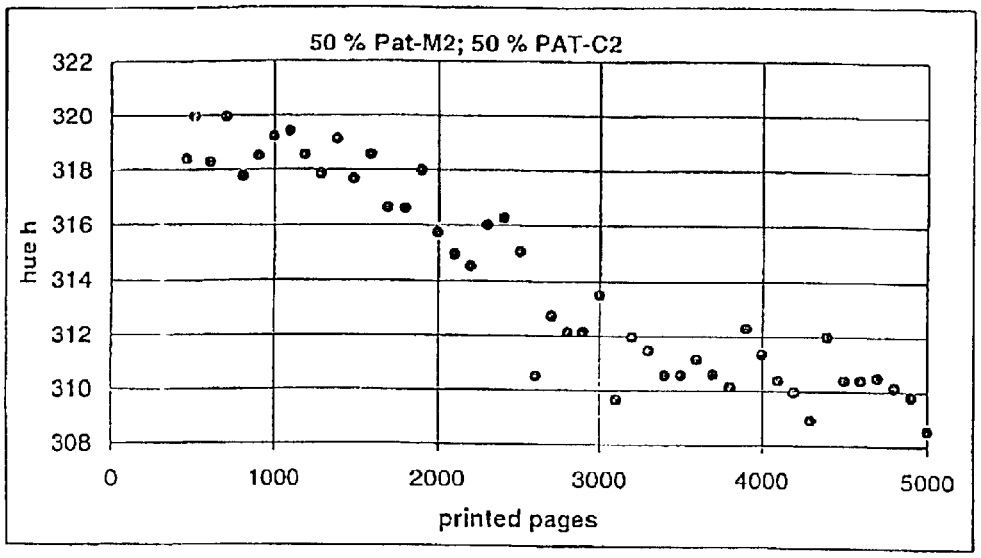
Figure 3D:
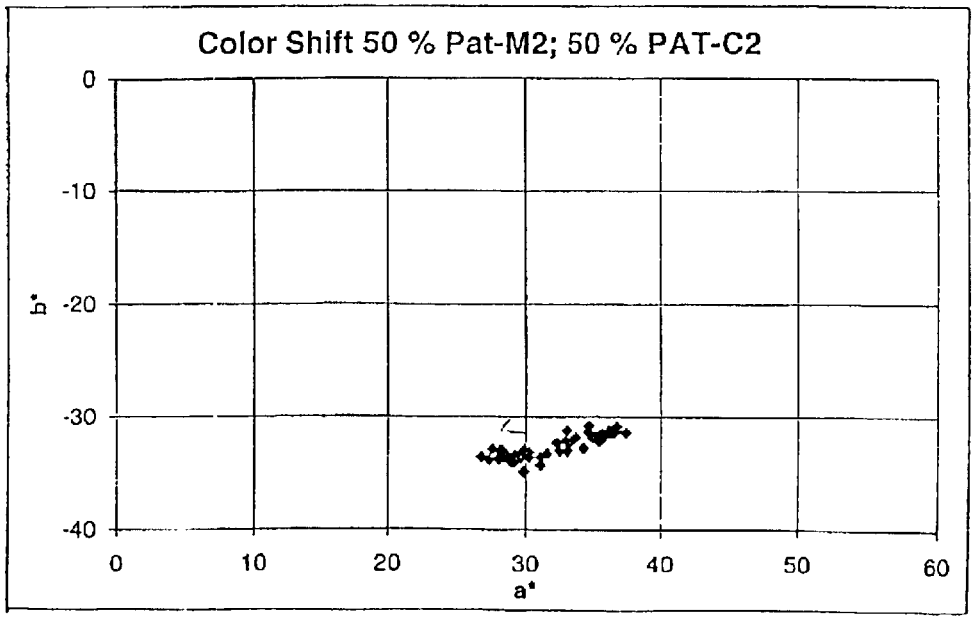

These toners were not suitably mixable. The printing of 5000 pages of 12 inch paper was performed as described in Example 1. The evaluation was carried out as described in Example 1. A color shift was observed throughout all 5000 pages. The hue and chroma changed. Furthermore, a de-mixing occurred at the leading edge of a printed solid tone. The results are shown in FIGS. 3*a*–3*d*.

Comparative Example 2

A magenta toner Pat-M-1 was mixed with a cyan toner Pat-C-1. The toner Pat-M-1 has the same formulation as the toner Pat-M-2 except that the binder resin (2) was replaced with the binder resin (3) which was prepared as described below.

135 g of ethylene glycol, 420 g of neopentyl glycol, 700 g of terephthalic acid, 250 g of 1,2,4-benzenetricarboxylic acid, and a conventional catalyst used for esterification are placed in a two-liter four-neck glass flask equipped with a thermometer, a stainless steel stirring rod, a reflux condenser and a nitrogen inlet tube. The reaction is proceeded by heating the contents in a mantle heater in a nitrogen gas stream at 220° C. under reduced pressure for the second half of the course of reaction, while stirring the contents.

The obtained polyester resin has an acid value of 42.5 mgKOH/g and a softening point of 137.1° C. as determined by "koka-type" flow tester. This obtained resin is referred to as "Binder Resin (3)".

This toner has an acid value of 52.1 mgKOH/g.

The toner Pat-C-1 has the same formulation as the toner Pat-C-2 except the Binder resin (2) was replaced with the Binder resin (3). The acid value of this toner is 54.2 mgKOH/g.

Figure 4A:
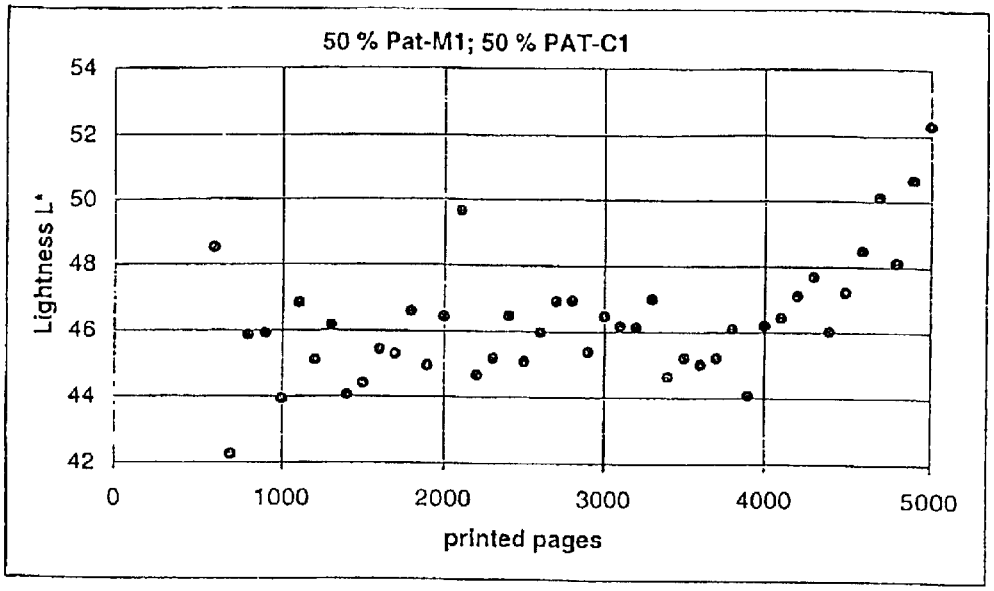
Figure 4B:
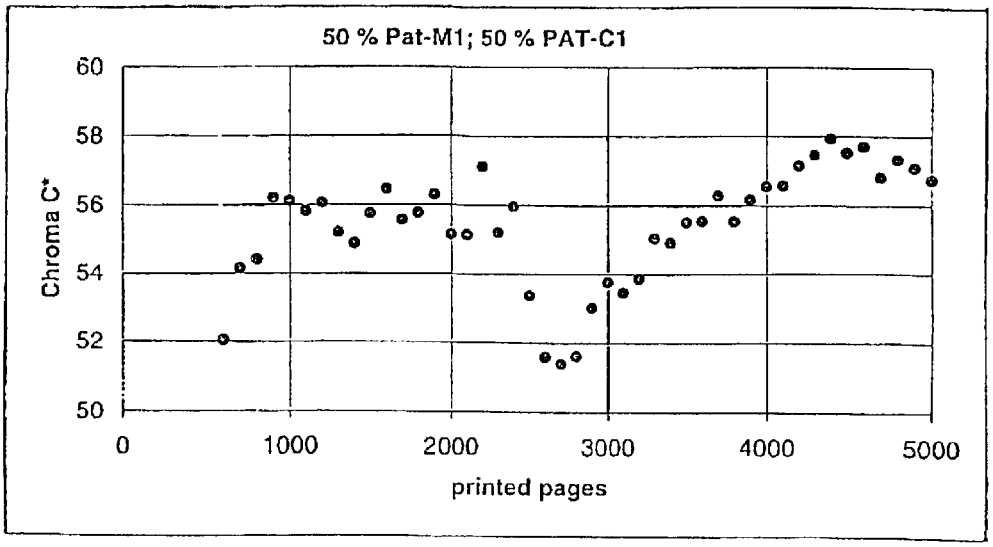
Figure 4C:
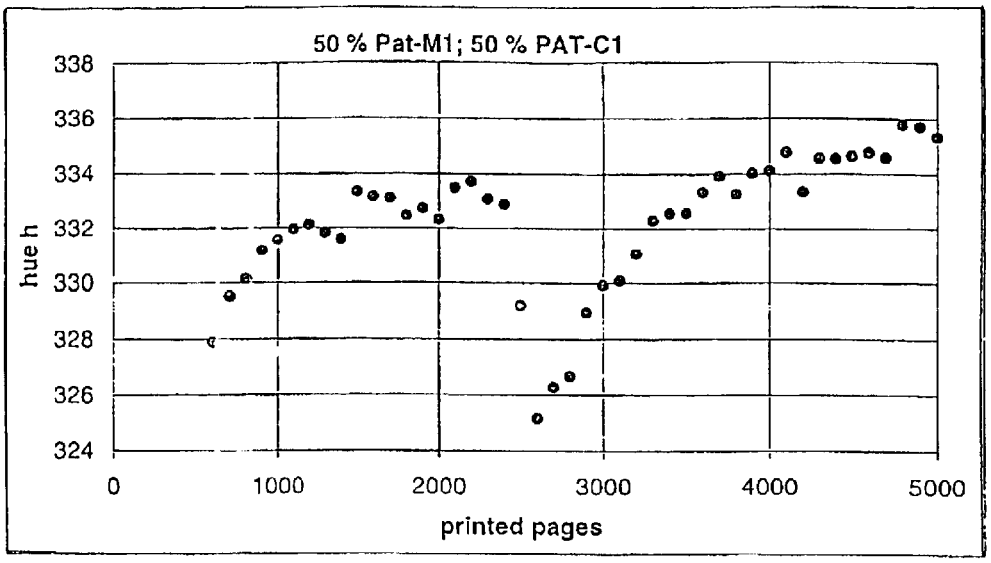
Figure 4D:
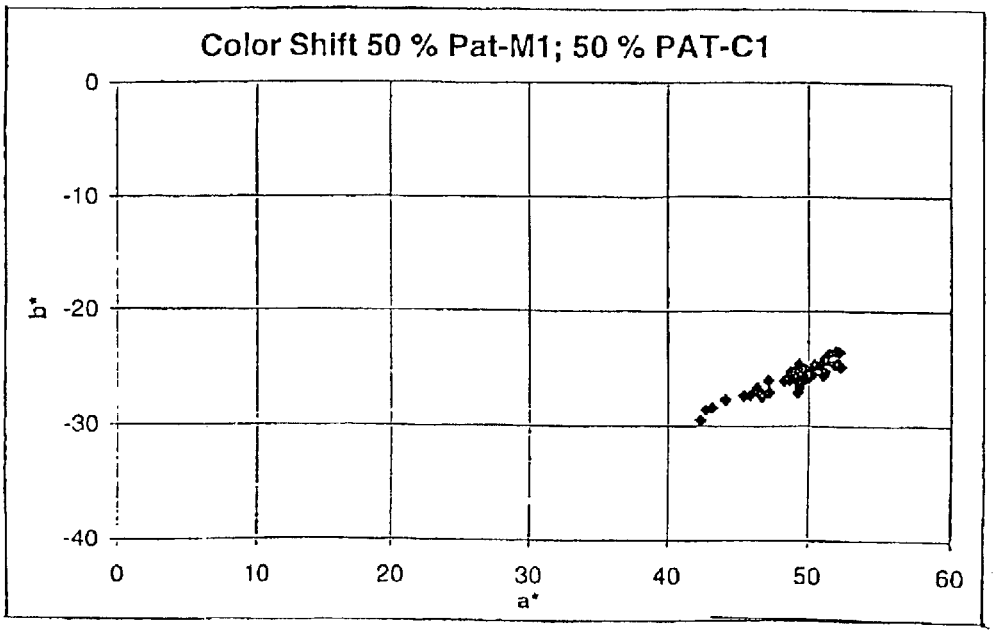

These two toners were mixed in a weight ratio of 1:1. These toners were not suitably mixable. The printing of 5.000 pages of 12 inch paper was performed as described in Example 1. The evaluation was carried out as described in Example 1. A color shift was observed throughout all 5.000 sheets. The chroma changed and the hue showed a strong shift towards magenta. The results are shown in FIGS. 4*a*–4*d*.

What is claimed is:

1. A process for the preparation of a toner mixture which comprises mixing a first toner with at least one further toner wherein the first toner has an acid value of from 0.1 to 30 mgKOH/g and comprises at least one binder resin and at least one coloring agent, wherein said binder comprises as the main component a polyester resin and wherein the further toners comprise at least one binder resin and optionally at least one coloring agent.

2. Process as defined in claim 1, wherein the binder resin of the at least one further toner comprises as the main component a polyester resin and wherein said further toner (s) has (have) an acid value of from 0.1 to 30 mgKOH/g.

3. Process as defined in claim 1 or 2, wherein the acid value of the first toner and optionally of the further toners is within the range of 0.1 to 25 mgKOH/g.

4. Process as defined in any one of the claims 1 to 3, wherein the acid value of the first toner and optionally of the further toners is within the range of 5 to 25 mgKOH/g.

5. Process as defined in any one of the claims 1 to 4, wherein the coloring agent of each of the toner is comprised of yellow, magenta, cyan, black, red, green, blue, orange, white, grey, fluorescent, metallic or metallic effect or mixtures thereof.

6. Process as defined in any one of the claims 1 to 5, wherein the volume average diameter of each toner in the toner mixture is between 3 $\mu$m and 20 $\mu$m as measured by Coulter Multisizer with 100 $\mu$m aperture.

7. Process as defined in any one of the claims 1 to 6, wherein the average diameter (by volume) of each toner in the toner mixture is between 5 $\mu$m and 15 $\mu$m as measured by Coulter Multisizer with 100 $\mu$m aperture.

8. Process as defined in any one of the claims 1 to 7, wherein the difference of apparent densities of said two or more toners to be mixed is 0,1 g/cm$^3$ or less.

9. Process as defined in any one of the claims 1 to 8, wherein the difference of apparent densities of said two or more toners to be mixed is 0,05 g/cm$^3$ or less.

10. Process as defined in any one of the claims 1 to 9, wherein the total amount of the coloring agent(s) in each toner is approximately 0.1% to 25% by weight, based on the total weight of the toner composition.

11. Process as defined in any one of the claims 1 to 10, wherein the toner particles comprise a surface additive in an amount of 0,1% to 6% by weight, based on the total weight of the composition of each of the toners.

12. Developer composition comprising the toner mixture obtainable by a process as defined in any one of the claims 1 to 11.

13. Developer composition as defined in claim 12, further comprising a carrier.

14. Developer composition as defined in claim 13, wherein the carrier particles have a rugged surface.

15. Developer composition as defined in claim 13 or 14, wherein the carrier has a resistivity of from 7 to 12 log Ω, as measured by C-Meter of Epping GmbH.

16. Method for multi-colored printing of a recording medium with an electrographic printer device, comprising at least a first and a second printing station, said method comprising steps:

applying a first toner image of a conventional toner of a first color onto the recording medium by said first printing station and applying a second toner image of a toner mixture obtainable by a process of any of the claims 1 to 11, and having a second color onto the recording medium by said second printing station.

* * * * *